United States Patent [19]

Bourgeois et al.

[11] 3,946,535

[45] Mar. 30, 1976

[54] CARRIER APPLICATING MACHINE AND METHOD

[75] Inventors: Francis H. Bourgeois, Oak Park; Edward J. McArdle, Morton Grove, both of Ill.

[73] Assignee: Illinois Tool Works Inc., Chicago, Ill.

[22] Filed: May 6, 1975

[21] Appl. No.: 575,114

Related U.S. Application Data

[63] Continuation of Ser. No. 424,427, Dec. 28, 1973, abandoned.

[52] U.S. Cl. ..... 53/35; 53/48; 53/196

[51] Int. Cl.[2] ..... B65B 27/04

[58] Field of Search ..... 53/3, 35, 48, 49, 196

[56] References Cited

UNITED STATES PATENTS

| | | | |
|---|---|---|---|
| 3,032,943 | 5/1962 | Reimers et al. | 53/48 |
| 3,032,944 | 5/1962 | Hull et al. | 53/48 |
| 3,383,828 | 5/1968 | Cunningham | 53/48 X |
| 3,404,505 | 10/1968 | Hohl et al. | 53/48 X |
| 3,742,677 | 7/1973 | Best | 53/48 X |
| 3,816,968 | 6/1974 | Morgan et al. | 53/48 |

*Primary Examiner*—Robert L. Spruill

*Attorney, Agent, or Firm*—E. L. Benno; R. W. Beart

[57] ABSTRACT

A machine and method for applying an apertured carrier to containers to form a carrier pack are disclosed. The machine includes a lug wheel which draws a carrier web from a stock and positions the carrier web at a preliminary station. A plurality of angularly spaced pins are mounted on each side of a pinwheel, and these pins engage secondary carrier apertures formed at locations spaced apart from the primary apertures. As the pinwheel turns, a spreader cam forces the pins axially apart to transversely deform the carrier without substantially deforming it in a longitudinal direction. So oriented, the carrier is forced over a plurality of containers to form a pack. A plow then positively disengages the carrier and containers constituting the pack from the pins.

12 Claims, 11 Drawing Figures

20
42
49
48
47
46
43
41
44
59
58
60
57
25
54
51
52
53
63
65
70
75
76
69
68
9
91
90
22
23
128
86

CARRIER APPLICATING MACHINE AND METHOD

This is a continuation of Ser. No.424,427, filed Dec. 28, 1973, now abandoned.

BACKGROUND OF THE INVENTION

This invention relates generally to container packaging, and more particularly concerns machines and methods for the high speed, low cost assembly of containers into sales packs.

For some time, cans and small bottles have been assembled into packs for merchandising. For example, beverage container cans or small bottles are often packaged in units or packs of six containers for retail sale. Such packs have met with wide consumer acceptance, and have assisted in increasing the sales of products so presented for retail sale.

A number of machines have been devised for assembling these containers and a common or interconnecting carrier member into retail packs. Several of these machines have met with considerable commercial success. Among these are machines described in U.S. Pat. Nos. 2,929,181 to Poupitch, 3,032,943 to Reimers et al, and 3,032,944 to Hull et al.

It is the general object of the present invention to provide a container pack assembling machine and a method of pack assembly which result in high speed container pack production at low cost.

It is another object of the invention to provide such a machine and assembly method which are especially adapted for use with plastic bottle containers and the like.

Still another object is to provide a container pack assembling machine which will give long service life. An associated object is to provide trouble-free operation by eliminating violent part motion and intermittent container or carrier movement through the machine.

Yet another object of the invention is to provide a container pack assembling machine wherein the carrier member is engaged and firmly held throughout its movement through the machine to avoid loss of registry with the synchronously moving containers until the carrier and containers have been firmly interengaged.

Other objects and advantages of the invention will become apparent upon reading the following detailed description and upon reference to the drawings. Throughout the description, like reference numerals refer to like parts.

DETAILED DESCRIPTION

Figure 1:
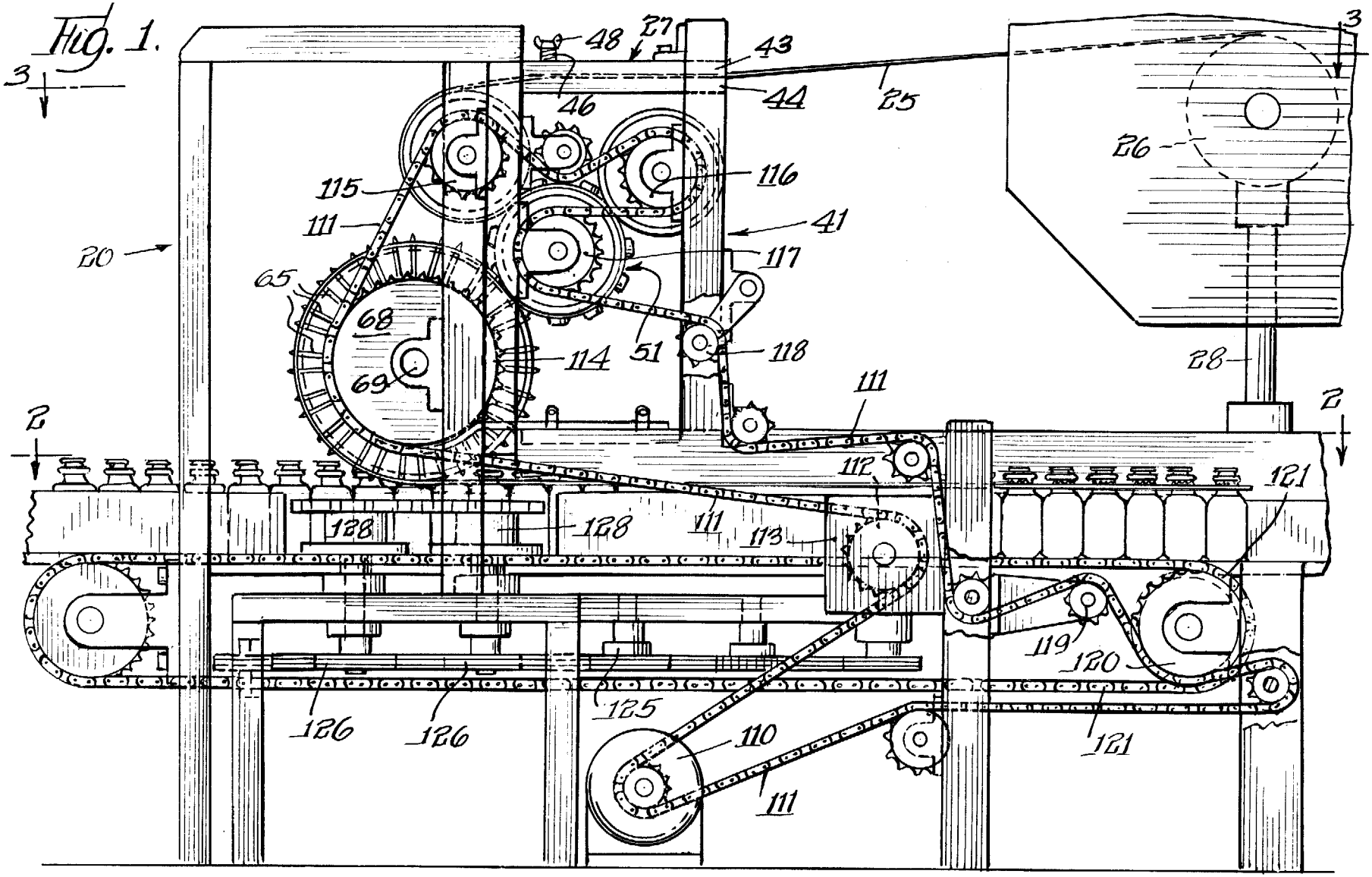
FIG. 1 is a fragmentary elevational view of the machine showing a carrier web, preliminary web positioning mechanisms, main carrier web engagement devices, apparatus by which the carrier web is applied to a moving stream of containers, and associated structures.

While the invention will be described in connection with a preferred embodiment and procedure, it will be understood that it is not intended to limit the invention to this embodiment or procedure. On the contrary, it is intended to cover all alternatives, modifications, and equivalents as may be included witin the spirit and scope of the invention.

Turning first to FIGS. 1–4, there is shown a novel machine 20 for assembling a carrier 21 over the tops 22 of containers 23 to form carrier packs. This carrier is similar to that disclosed in U.S. Pat. No. 2,936,070 to Poupitch. However, as may be envisioned from particular reference to FIGS. 1 and 11, the carrier 21 can be provided as part of an elongated web 25 wound upon a roll 26, which is conveniently carried on a stand 28. Each individual carrier 21 is attached to longitudinally neighboring carriers by perforations or material surrounding elongated slots 29 which are oriented in a transverse carrier direction at longitudinally spaced apart positions.

Figures 6, 7, 8:
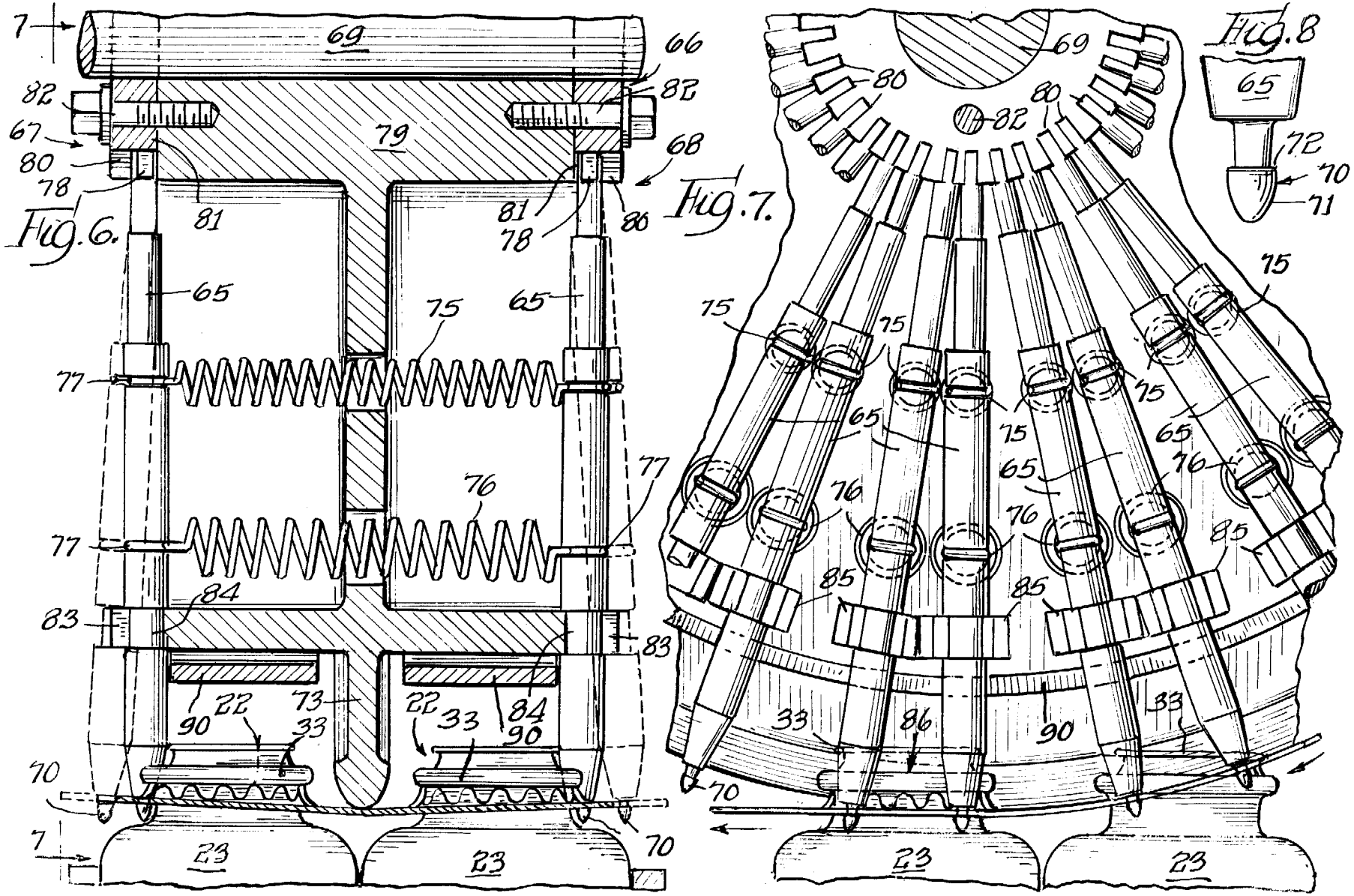
FIG. 6 is a sectional view taken substantially in the plane of line 6—6 in FIG. 4.
FIG. 7 is a sectional view taken substantially in the plane of line 7—7 in FIG. 6.
FIG. 8 is a fragmentary elevational view showing in further detail the carrier web-engaging pin member ends.
Figure 11:
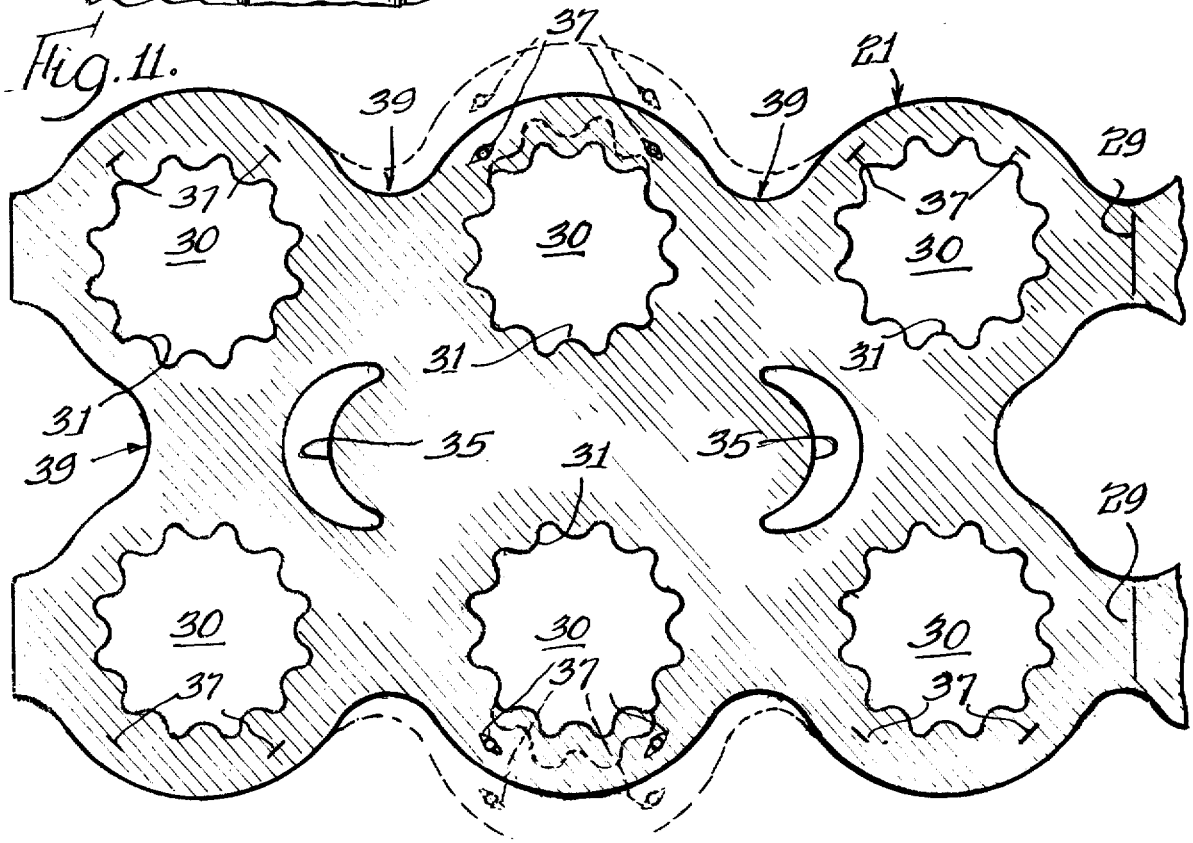
FIG. 11 is a plan view of the carrier member which is to be assembled over the product containers to form the container packs.

In its illustrated embodiment, the carrier 21 is provided with six primary apertures 30 defined by scalloped edges 31 which are adapted to be deformed into a generally frustoconical shape and engage collars 33 formed on the container tops 22, as shown in FIG. 6 and elsewhere. As illustrated in FIG. 11, these six primary apertures 30 are arrayed in two longitudinally oriented rows of three apertures each. Intermediate these two aperture rows are finger holes 35 which can be used by the pack-purchasing customer to grasp the carrier 21 and lift the pack. Small secondary apertures, here taking the form of slots 37, are arrayed along the longitudinal sides near edges of the carrier 21 at positions spaced apart from and outside the primary apertures 30. The purpose of the secondary apertures 37 is explained below. To minimize the amount of raw material used in forming the carrier 21, enlarged scalloped indentations 39 can be formed upon the carrier periphery. The carrier 21 can be formed of a polyethylene plastic or other suitable thin, strong, flexible material.

It is a feature of the invention that the carrier web 25 is drawn from the stock roll 26, is longitudinally tensioned, and is preliminarily positioned for accurate engagement by machine parts which apply the web to the containers 23. To this end, the machine 20 is provided with a frame 41 upon which is mounted a tensioning device 42 shown in FIG. 4 and elsewhere. Here, this tensioning device includes two generally opposing plates 43 and 44 which are biased toward one another into engagement with opposite sides of the carrier web 25 by any convenient means. The illustrated biasing device comprises a spring 46 secured over a stud 47 threaded into one plate 44; the spring 46 is compressively urged against the opposite plate 43 by an adjustable wing nut 48. The tensioning device 42 is mounted upon the frame 41 by any known means such as bolts 49.

In accordance with the invention, means are provided to draw the carrier web 25 from the stock roll 26 and preliminarily position the web for action by engagement devices. To this end, a lug wheel 51 is keyed to an axle 52 mounted upon the frame 41 and includes a somewhat resilient cylinder 53 through which protrude a series of relatively large lugs 54. In carrying out the invention, these lugs 54 are formed to substantially engage the entire edge 31 of all the primary carrier apertures 30. This extensive carrier-lug interengagement lowers the stress imparted to the carrier 21 at any given point by the machine, yet permits the carrier web 25 to be drawn from the stock roll 26 and through the tensioning device 42 with a firm, relatively high speed action. Further, stresses on machine parts are reduced.

Figures 4, 5:
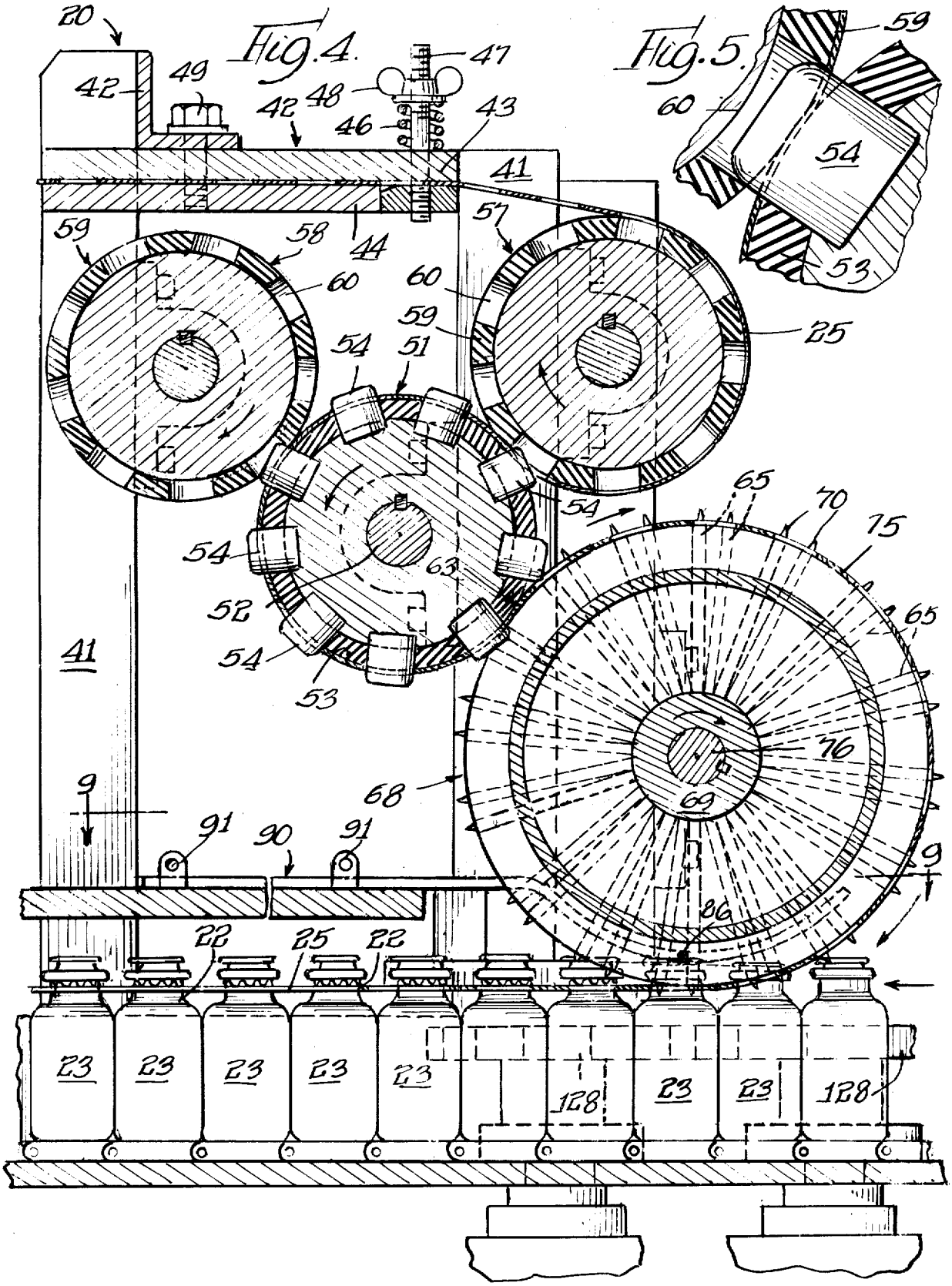
FIG. 4 is a sectional view taken substantially in the plane of line 4—4 in FIG. 3, elevational in aspect but reversed in orientation relative to FIG. 1.
FIG. 5 is a fragmentary sectional view showing in further detail the interengagement of the preliminary web positioning lugs and associated web-conveying wheels shown in FIG. 4.

To assist in positioning the carrier web 25 upon the lug wheel 51, idler wheels 57 and 58 are located to abut the lug wheel 51. Each idler wheel includes a resiliently-surfaced cylinder 59, in which lug-complementing bores 60 are formed. Thus, when the carrier web 25 is drawn over the lug wheel 51, the constituent carriers 21 are impressed firmly over the lugs 54 by the actions of these idler wheels 57 and 58, as illustrated in FIGS. 4 and 5. This impressment precisely aligns and locates the carrier web 25 for subsequent machine actions, yet does so in an inexpensive manner which does not require the application of great force to the carriers 21 or any machine part.

Next, the lug-engaged carrier web 25 is presented at a preliminary work station 63 for engagement by carrier-engaging devices such as pins 65. It is another feature of the invention that engagement occurs at a plurality of secondary aperture points 37 spaced apart from the primary web apertures 30 in a two-column longitudinal array near the carrier edges. Such engagement is smooth, and positive, yet involves low pressures on machine and carrier parts. As illustrated in FIGS. 4 and 6–8, the engagement devices or pins 65 are mounted on each side 66 and 67 of a bi-sided pinwheel 68 carried in turn on the machine frame 41 for synchronous motion with the continuously moving containers 23 and the lug wheel 51. The pinwheel 68 is mounted upon an axle 69 having its axis oriented perpendicularly to the longitudinal web dimension and parallel to the transverse web dimension, as can be envisioned from reference to FIGS. 3, 4, 6 and 7.

As the carrier web 25 continuously arrives at the preliminary work station 63, the pins 65 are endlessly cycled into engaging contact with it. The illustrated interengagement of the lug wheel 51 and the pinwheel 68 forces pin tips 70 to penetrate the secondary carrier aperture slots 37 to engage and retain the carrier 21 upon the pins 65 until positive release occurs as explained below. To assist in this carrier retension, the pin tips 70 are provided with expanded heads 71 and reversely facing surfaces 72 formed to engage carrier material adjacent the slots 37. A series of median fingers 73 are included on the wheel between the wheel sides 66 and 67 to further help position, tension and transversely strain the engaged carrier 21.

Not only are the pins 65 arrayed about each side 66 and 67 of the pinwheel 68 in angularly spaced relationship, but each pin 65 located on one side 66 of the wheel is mounted in registry with a pin 65 mounted upon the opposite side 67 of the wheel 68. Moreover, as can be seen from FIG. 6 in particular, each pin 65 is biased toward its partner registered pin on the opposite wheel side. Here, this biasing effect is accomplished by two spring members 75 and 76 whose ends engage small notches 77 formed on each pin 65.

The interior or axially proximal pin ends 78 need not be secured to the wheel hub 79, but can be formed for slidable mounting within slots 80 formed on the wheel hub 79. If desired, these slots 80 can be directly formed in pinwheel hub covers 81 which are then mounted to the wheel as by bolts 82. Additional slots 83 formed near the wheel circumference are oriented to permit motion of the pin ends 70 in a direction parallel to the wheel axis without permitting substantial radial motion or motion in a direction which would angularly displace any pin 65. Here, reduced stem portions 84 are formed on each pin 65 to permit engagement with the slots 80 and, if desired, with covering collars 85.

In accordance with another aspect of the invention, the carrier-engaging pins 65 penetrate the carrier web 25 at the preliminary work station 63 and preliminarily tension the constituent carriers 21. When the pins 65 are mounted as described above, the carrier material surrounding each primary aperture 30 is tensioned or stressed, but is not substantially strained or deformed in either a longitudinal or transverse direction. However, as the pinwheel 68 turns and the engaged carrier web 25 approaches a final work station 86, each pin 65 on one side 66 of the pinwheel is spread in a direction parallel to the wheel axis away from its normally axially retracted position and away from its registered mate upon the opposite pinwheel side 67. Such motion further tensions and deforms or strains the penetrated and engaged carrier web 25, including the material surrounding the primary apertures 30, in a transverse direction.

Figure 9:
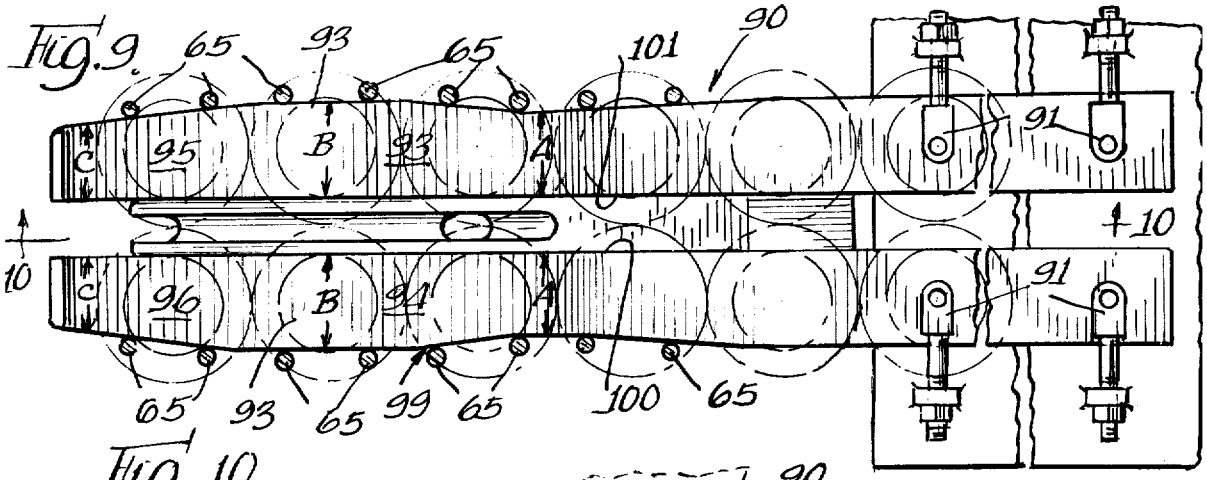
FIG. 9 is a sectional view taken substantially in the plane of line 9—9 in FIG. 4 showing the pin spreader cam device, the view being plan in aspect and oriented similarly to FIG. 1, but reversed in orientation relative to FIG. 4.
Figure 10:
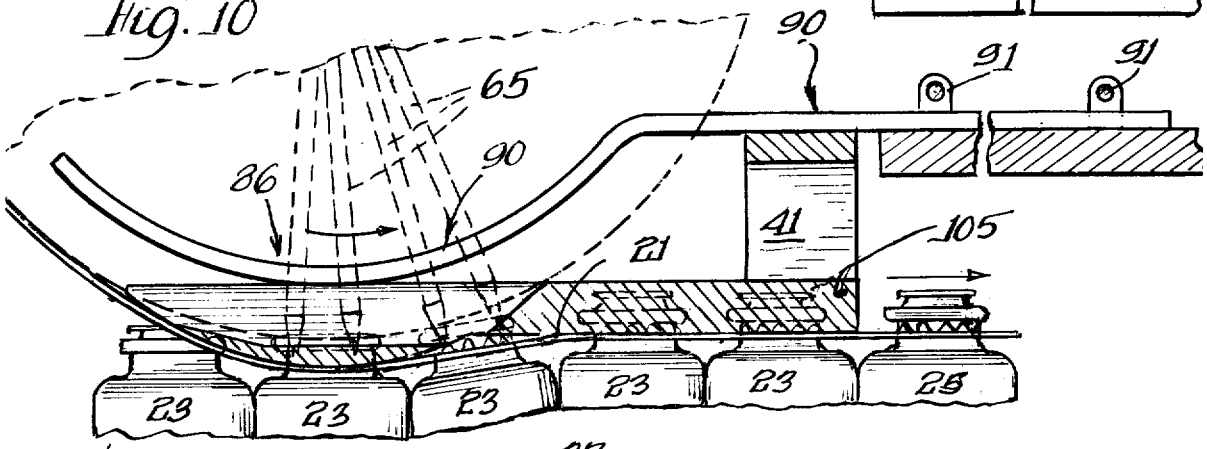
FIG. 10 is a sectional view taken substantially in the plane of line 10—10 in FIG. 9 and showing in further detail the spreader cam mechanism and the plow mechanism by which the containers and attached carrier are separated from the assembly machine, the view being plan in aspect and oriented similarly to FIGS. 1 and 9, but reversed in orientation relative to FIG. 4.

To accomplish this, a spreader cam 90 shown in FIGS. 4, 9 and 10 is mounted, as by bolts 91, to the machine frame 41. Here, the spreader cam 90 takes the form of two scoop-shaped members 93 and 94 which are spaced apart from one another to permit the passage of the wheel-mounted median finger member 73. As can be seen from particular reference to FIG. 4, each cam member 93 and 94 is curved at one end 95 and 96 respectively to engage the passing pins 65 at approximately uniform radial distances throughout the pin-cam engagement travel zone. During cam and pin interaction, deformation of the engaged and penetrated carrier 21 in a transverse direction is caused, but no substantial deformation in the longitudinal direction occurs, since the angular interrelationship of the pins 65 remains constant throughout machine operation. Thus tensioned and deformed, the carrier 21 is forced over the tops 22 of the containers 23, at the work station 86, thereby camming the primary apertures 30 of the carrier 21 over the shoulders 33 located upon the container tops 22.

To cause the axial pin-spreading action described above, each cam member 93 and 94 is provided with a respective spreader pin-engaging surface 98 and 99 which originates at a relatively reduced distance A from a planar cam datum surface 100 and 101 respectively, as shown particularly in FIG. 9. The cam surfaces 98 and 99 then expand to respective distances B from the datum surfaces 100 and 101, and subsequently gradually return to reduced distances C from the datum surfaces 100 and 101.

In accordance with yet another feature of the invention, the carrier 21 and now-attached containers 23 leaving the work station 86 are positively separated from the pins 65. In the illustrated embodiment, this is accomplished by a plow member 105 mounted upon the frame 41 below the spreader cam 90 at the final work station 86. As the carrier 21 and containers 23 move past the work station 86, the plow 105 intercepts the carrier 21 and separates it from the penetrating pins 65, and then directs the carrier 21 and attached containers 23 in a downstream direction away from the work station 86.

Figure 2:
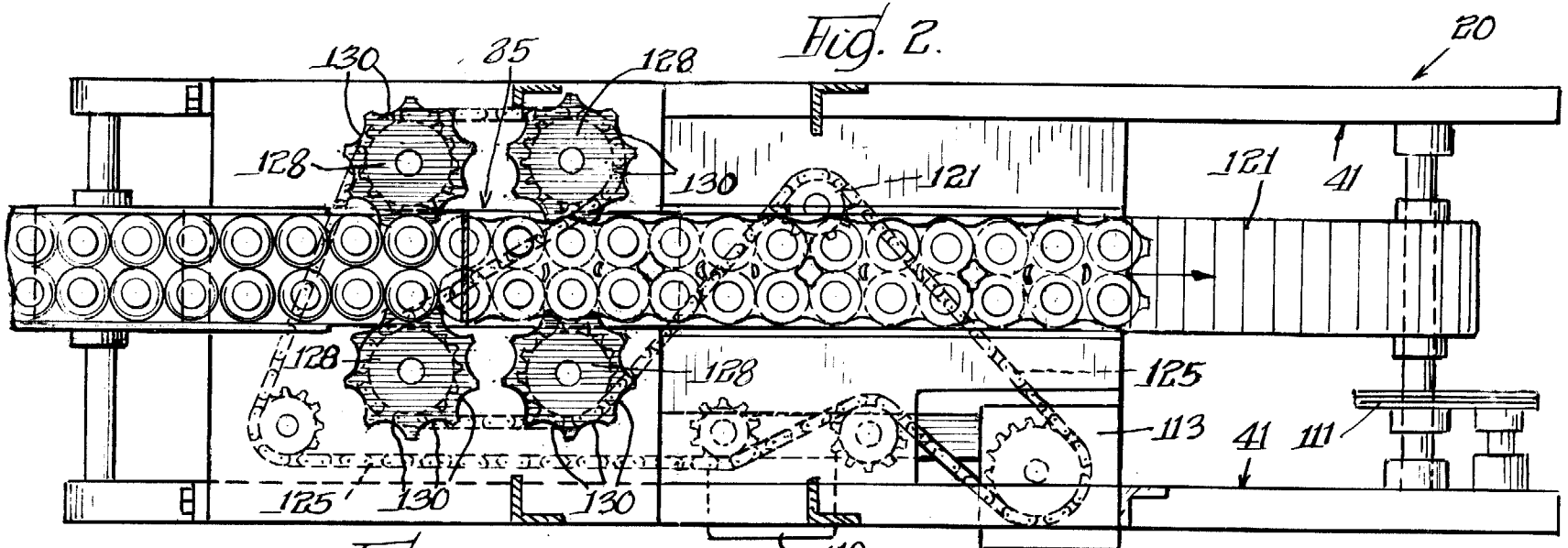
FIG. 2 is a sectional view taken substantially in the plane of line 2—2 in FIG. 1.
Figure 3:
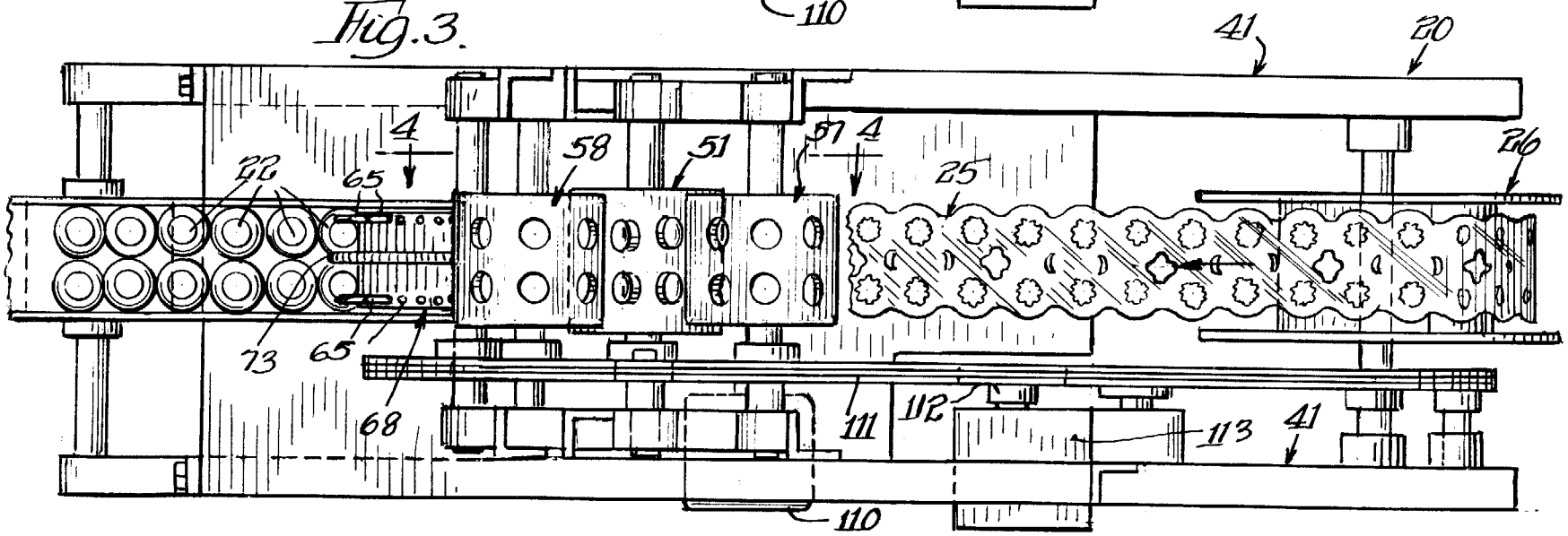
FIG. 3 is a sectional view taken substantially in the plane of line 3—3 in FIG. 1.

It is a feature of the invention that the initially separated carrier web 25 and containers 23 are continually moved toward the final work station 86 and the interattached carriers 21 and containers 23 are correspondingly moved away from the work station 86. To this end, a drive mechanism is provided to synchronize the motions of the lug wheel 51, the pinwheel 68, the web 25, and the containers 23. As illustrated in FIGS. 1–3, an integrated drive, here including a drive motor 110 and an endless belt 111 comprising twin roller chains is operated from any convenient power source such as electricity. The belt 111 passes in turn over the sprocket wheel 112 of a conveyor gearbox 113, whose function is described later, and the sprocket wheels 114–117 of the pinwheel 68, the carrier idler wheels 57 and 58, and the lug wheel 51 respectively. After passing over convenient tension-maintaining idler rollers 118 and 119, the moving belt 111 then synchronously engages the drive sprocket 120 of a container-carrying conveyor belt 121.

It is yet another feature of the invention that the containers 23 are urged into the work station 86 by motion synchronized with the described machine parts. To this end, the gearbox 113 is provided with an output drive 125, here comprising twin roller chains, which engage the drive sprockets 126 of several star wheels 128 located at container-engaging positions near each side of the container conveyor belt 121. Each star wheel 128 is provided with a container-receiving and spacing scalloped surface 130 which engages the sides of the containers 23. By this engagement, the star wheels positively separate the containers 23 and position them upon the continuously moving container conveyor belt 121 in pre-selected locations for subsequent engagement by the apertures 30 formed in the carrier 21.

The invention is claimed as follows:

1. In a machine for applying an apertured carrier stock to pluralities of containers to form packages in which the machine includes means for continuously supplying said carrier stock to an application station and further includes means for contemporaneously continuously supplying a series of containers to said application station wherein the improvement comprises, a rotating pinwheel mounted in said application station and comprising a plurality of pins having pointed tips, said pins mounted in said pinwheel in spaced apart pairs for rotation therewith for receiving the longitudinal side marginal edge of said carrier stock at positions spaced from the container receiving apertures of said carrier stock projected onto the tips of said pins, rotating means receiving said carrier stock thereabout and for projecting the longitudinal side marginal edges of said carrier stock onto the pointed tips of said pins, and spreader cam means for spreading said spaced apart pairs of pins to stretch said carrier stock projected thereon for application to said series of containers with said containers extending through the apertures of said carrier stock.

2. In a machine as defined in claim 1, and said rotating means for projecting said carrier stock onto said pins comprising a rotating lug wheel in substantial tangential alignment with said pinwheel, said lug wheel being formed and arranged to receive said carrier stock thereabout and to project the longitudinal side marginal edges of said carrier stock onto the pointed tips of said spaced apart pairs of pins as said lug wheel and said pinwheel rotate.

3. In a machine as defined in claim 2, and a plurality of lugs mounted circumferentially about said lug wheel and extending radially outwardly thereof, said lugs being positioned to project through said apertures of said carrier stock to align said carrier stock on said lug wheel for projection of the longitudinal side marginal edges of said carrier stock onto the pointed tips of said spaced apart pairs of pins.

4. In a machine as defined in claim 3, and the periphery of said lug wheel about said lugs having a resilient surface thereabout to resiliently support said carrier stock thereon.

5. In a machine as defined in claim 4, and said resilient surface of said lug wheel having holes to receive the pointed tips of said spaced apart pairs of pins therein.

6. In a machine as defined in claim 1, and spring means between each pair of said spaced apart pairs of pins for biasing the tips of each pair of said spaced apart pairs of pins toward each other, said spreader cam means being fixedly positioned to project between said spaced apart pairs of pins and formed to progressively cam each pair of said spaced apart pairs of pins apart against the bias of said spring means to stretch said carrier stock for application to said containers as said pinwheel rotates and to permit each pair of said spaced apart pairs of pins to move together upon application of said carrier stock to said containers as said pinwheel rotates.

7. In a machine as defined in claim 1, and a plow fixed in said machine at a position between said spaced apart pairs of pins to hold said carrier stock on said containers upon application of said carrier stock to said containers as said pinwheel rotates.

8. In a method of applying a longitudinally and transversely dimensioned carrier having a plurality of primary apertures to containers to form a carrier pack, in which the carrier is continuously supplied to an application station and in which a series of containers is continuously supplied to said application station, wherein the improvement comprises the steps of engaging the carrier at a plurality of locations spaced apart from the primary apertures by penetrating the longitudinal side marginal edges of said carrier at said application station with a plurality of pins mounted for rotation on a pinwheel about an axis, spreading the pins while the pinwheel is rotated to temporarily strain the carrier, synchronously applying the engaged carrier to said series of containers moving past the pinwheel in said application station, and withdrawing the pins from the applied carrier.

9. In a method according to claim 8, including the steps of temporarily spreading the pins in a direction parallel to said pinwheel axis, stressing and straining the engaged carrier in its transverse direction about its primary aperture, and stressing without substantially straining the carrier in its longitudinal direction about its primary aperture.

10. In a method according to claim 9, including the step of retracting the spread pins to relax transverse stress and strain in the carrier before the pins are entirely withdrawn from the carrier.

11. In a method according to claim 8, including the steps of drawing a web of longitudinally interconnected carriers from a stock, longitudinally tensioning the carrier web, and preliminarily engaging the web substantially along all the web primary aperture edges to position the web for engagement by the pins.

12. In a method according to claim 11, including the step of forcing lugs into engagement with said primary apertures formed in the carrier.

* * * * *